US006824297B1

(12) United States Patent
Lee

(10) Patent No.: US 6,824,297 B1
(45) Date of Patent: Nov. 30, 2004

(54) PORTABLE WORKLIGHT ASSEMBLY

(75) Inventor: Wade Lee, Danville, CA (US)

(73) Assignee: EML Technologies LLC, Danville, CA (US)

( * ) Notice: Subject to any disclaimer, the term of this patent is extended or adjusted under 35 U.S.C. 154(b) by 160 days.

(21) Appl. No.: 10/216,073

(22) Filed: Aug. 10, 2002

Related U.S. Application Data

(60) Provisional application No. 60/311,326, filed on Aug. 10, 2001.

(51) Int. Cl.[7] ..... F21V 21/14

(52) U.S. Cl. ..... 362/413; 362/250; 362/388; 362/399; 362/431

(58) Field of Search ..... 362/410, 399, 362/413, 403, 431, 249, 250, 376, 418, 414, 388, 389, 400, 287, 285

(56) References Cited

U.S. PATENT DOCUMENTS

| | | | | |
|---|---|---|---|---|
| 2,165,562 A | | 7/1939 | Mack et al. | 206/223 |
| 4,228,489 A | | 10/1980 | Martin | 362/250 |
| D298,467 S | | 11/1988 | Stover | D26/63 |
| 4,894,759 A | | 1/1990 | Siems | 362/250 |
| D324,584 S | | 3/1992 | Beavers et al. | D26/140 |
| 5,195,823 A | | 3/1993 | Sidabras | 362/387 |
| 5,205,645 A | | 4/1993 | Lee | 362/431 |
| 5,243,507 A | | 9/1993 | Atkins et al. | 362/376 |
| 5,306,871 A | | 4/1994 | Lai | 174/65 R |
| 5,307,255 A | | 4/1994 | Chen | 362/410 |
| 5,386,358 A | | 1/1995 | Hillinger | 362/431 |
| D381,114 S | | 7/1997 | Xu | D26/140 |
| 5,695,278 A | | 12/1997 | Grossman et al. | 362/374 |
| 5,845,989 A | | 12/1998 | Leen | 362/410 |
| 5,964,524 A | | 10/1999 | Qian | 362/414 |
| 5,984,490 A | | 11/1999 | Leen | 362/240 |
| D426,670 S | | 6/2000 | Leen | |
| D428,518 S | | 7/2000 | Leen | |
| D428,519 S | * | 7/2000 | Leen | D26/138 |
| D436,680 S | | 1/2001 | Leen | D26/65 |
| 6,213,626 B1 | | 4/2001 | Qian | 362/413 |
| 6,220,728 B1 | | 4/2001 | Andrus et al. | 362/287 |
| D447,262 S | | 8/2001 | Leen | |
| D450,149 S | | 11/2001 | Leen | |
| D451,226 S | | 11/2001 | Leen | |
| 6,474,844 B1 | | 11/2002 | Ching | 362/285 |

OTHER PUBLICATIONS

"LumaPro 500 Watt Quartz Halogen Light Operating Instructions SRV15," published more than one year prior to priority date, pp. 1,3.

"Pro Series Plus+ Worklights," The Designers Edge [online] (2001) [retrieved on Sep. 22, 2003]. Retrieved from the internet, URL: http://designersedge.com/worklights.html, pp. 1–2.

* cited by examiner

*Primary Examiner*—Alan Cariaso
*Assistant Examiner*—Guiyoung Lee
(74) *Attorney, Agent, or Firm*—Elliot B. Aronson

(57) ABSTRACT

A worklight assembly that may as a stand-alone unit mountable on a tripod. One embodiment includes a linearly extending support member for the heads and a number of support feet extending outward from the support member for supporting the worklight assembly as a stand-alone unit. A mounting mechanism is captured on the worklight assembly so as to be retained with the assembly when used as a stand-alone unit and is nevertheless ready for attachment to the elevating support structure. The mechanism is disposed to avoid interference with the work surface when the assembly is positioned directly on the work surface. The mounting mechanism enables one-step mounting and demounting of the assembly from a tripod. An electrical power junction is disposed on the worklight assembly for distributing electrical power to the worklight heads in multi-head embodiments.

36 Claims, 6 Drawing Sheets

PORTABLE WORKLIGHT ASSEMBLY

This application claims priority in provisional application No. 60/311,326 filed Aug. 10, 2001.

BACKGROUND OF THE INVENTION

The present invention relates to worklights of the type having two or more worklight heads mounted on a portable base.

Portable worklights have proved useful in a variety of settings such as construction sites, industrial plants, automotive and auto body repair shops, artist and photographic studios, and around the home for do-it-yourself projects. These lights provide a high level of illumination over an extended area. In one format the lights are provided with a low built-in supporting base forming a stand that can be set directly on the ground or other work surface in a stable position. In another format the lights are intended to be set on a separate upright stand such as a tripod for greater height off the ground or work surface. Lights of this type are formed with a support frame that is adapted to be attachable to the tripod. Examples of such portable worklights are disclosed in U.S. Pat. No. 5,243,507 of Atkins et al.; U.S. Pat. No. 5,695,278 of Grossman et al.; U.S. Pat. No. 5,845,989 of Leen; and D381,114 of Xu.

Some attempts have been made to provide a convertible worklight that may be used in both ways either mounted on a tripod support or as a stand-alone unit that can be placed directly on the work surface. U.S. Pat. No. 5,386,358 of Hillinger, for example, discloses a light assembly with two quartz halogen worklight heads. Each head has attached legs that may be splayed apart to form a self-contained stand so that the individual light head may be used as a stand-alone unit. The legs may alternatively be folded together and inserted into a frame member that may be supported in turn on a vertical stand. U.S. Pat. Nos. 6,213,626 and 5,205,645 show a single worklight head that has a foldable leg/bracket arrangement. With the legs unfolded the worklight head may be used as a stand-alone unit. The legs folded together form a supporting bracket that may then be bolted directly to an elevating stand. More recently, a convertible worklight unit has become commercially available under the trade designation The Designers Edge that has a pair of quartz halogen worklight heads mounted on a framework that forms a stand permitting the pair of worklight heads to be placed as a unit directly on a work surface without the necessity of unfolding legs or brackets on the individual worklight heads. The stand is formed with a central aperture to permit the unit to be bolted to an elevating tripod.

SUMMARY OF THE INVENTION

The present invention provides a dual-use portable worklight assembly that is particularly adapted to facilitate an easy and convenient changeover between use as a stand-alone unit and use as a mounted unit. With only a minimum of effort the user may change over from a worklight assembly used as a stand-alone unit positionable on a work surface and a worklight assembly mounted on a tripod or other elevating support structure.

Briefly, the worklight assembly includes one or more worklight heads that are mounted on a base portion, which is formed at its lower reaches to engage the work surface and serve as a built-in stand providing support for the worklight assembly when the assembly is used as a stand-alone unit positioned on the work surface. A mounting mechanism is provided for alternatively mounting base portion on an elevating support structure such as a tripod and demounting the base portion from the elevating support structure. The mounting mechanism is captured on the worklight assembly so as to be retained with the assembly when the assembly is used as a stand-alone unit, yet the mechanism is in a ready operative disposition on the worklight assembly ready for attachment to the elevating support structure. The mounting mechanism has a disposition on the worklight assembly free from interference with and avoiding engagement with the work surface when the assembly is positioned as a stand-alone unit on the work surface. In multi-head embodiments an electrical junction is disposed on the worklight assembly for distributing electrical power to the worklight heads.

The worklight assembly is self-contained, is easy to mount on and remove from an elevating support structure, may be made in a compact, well-balanced format, is cost-effective to manufacture, allows for one-step mounting and demounting, and can be formed with no normally separable parts to keep track of.

In at least one of its embodiments the invention provides for a simple "position and turn" procedure for mounting the worklight assembly on an elevating support structure. The worklight assembly is merely positioned on the elevating support structure and a knob is turned to tighten down the assembly thereby offering a great convenience to the user. A compact, well-balanced form of the worklight assembly contributes to the ease with which the assembly can be mounted on and demounted from the elevating support structure.

In one compact, lightweight, economically manufactured, and easily manipulated embodiment of the invention the base portion is provided by a linearly extending support member on which the worklight heads are attached. Two tubular members at opposite lateral ends of the support member define the support feet for engaging the work surface. A centrally disposed handle member defines a grip member that is advantageously positioned to facilitate manipulating the worklight assembly while mounting it on a tripod or other elevating support structure. The electrical distribution junction may be mounted directly on the worklight assembly, for example, on the centrally disposed handle member.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
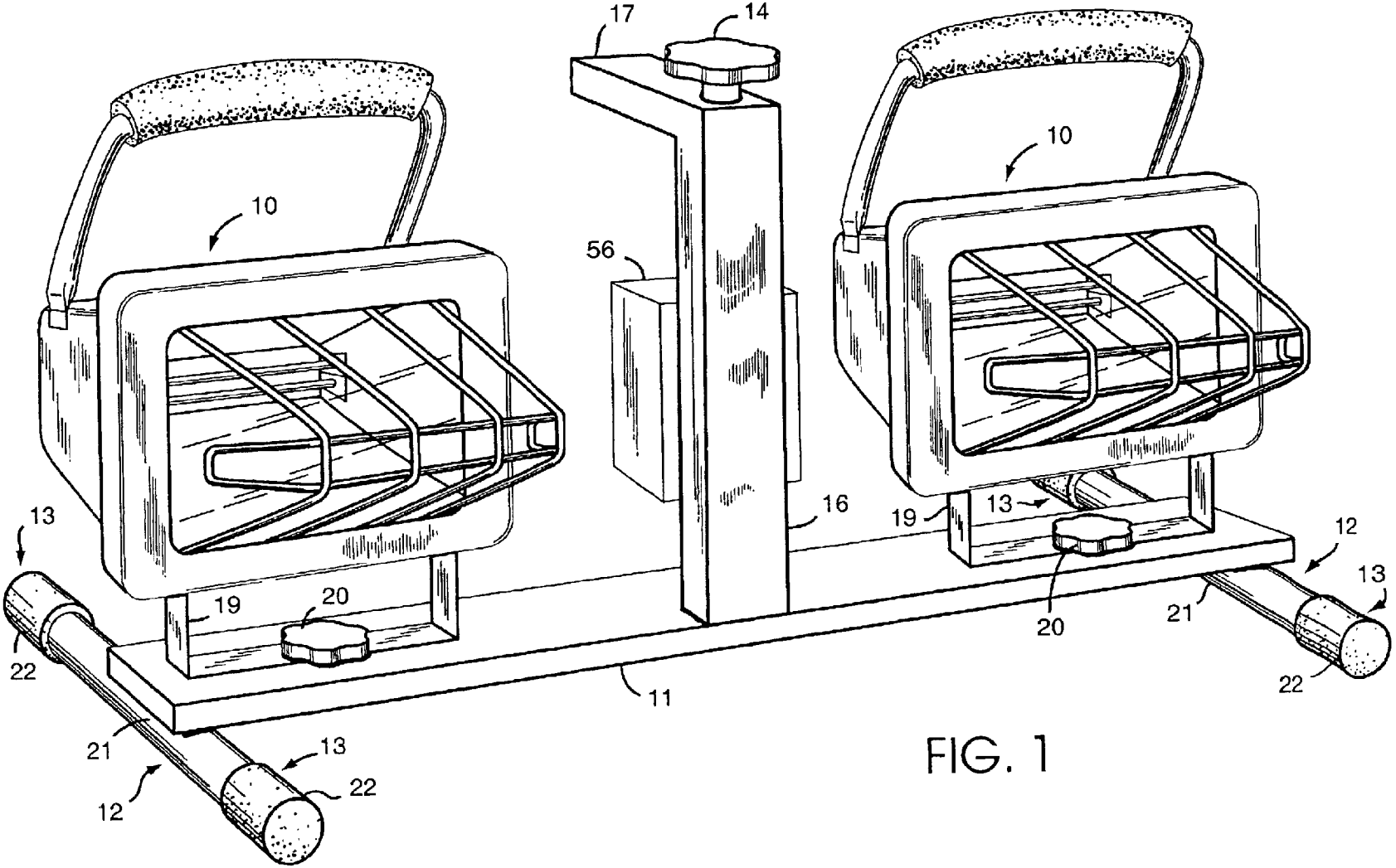
FIG. 1 is an overall front perspective view of a worklight assembly in accordance with the invention shown as a stand-alone unit.
Figure 2:
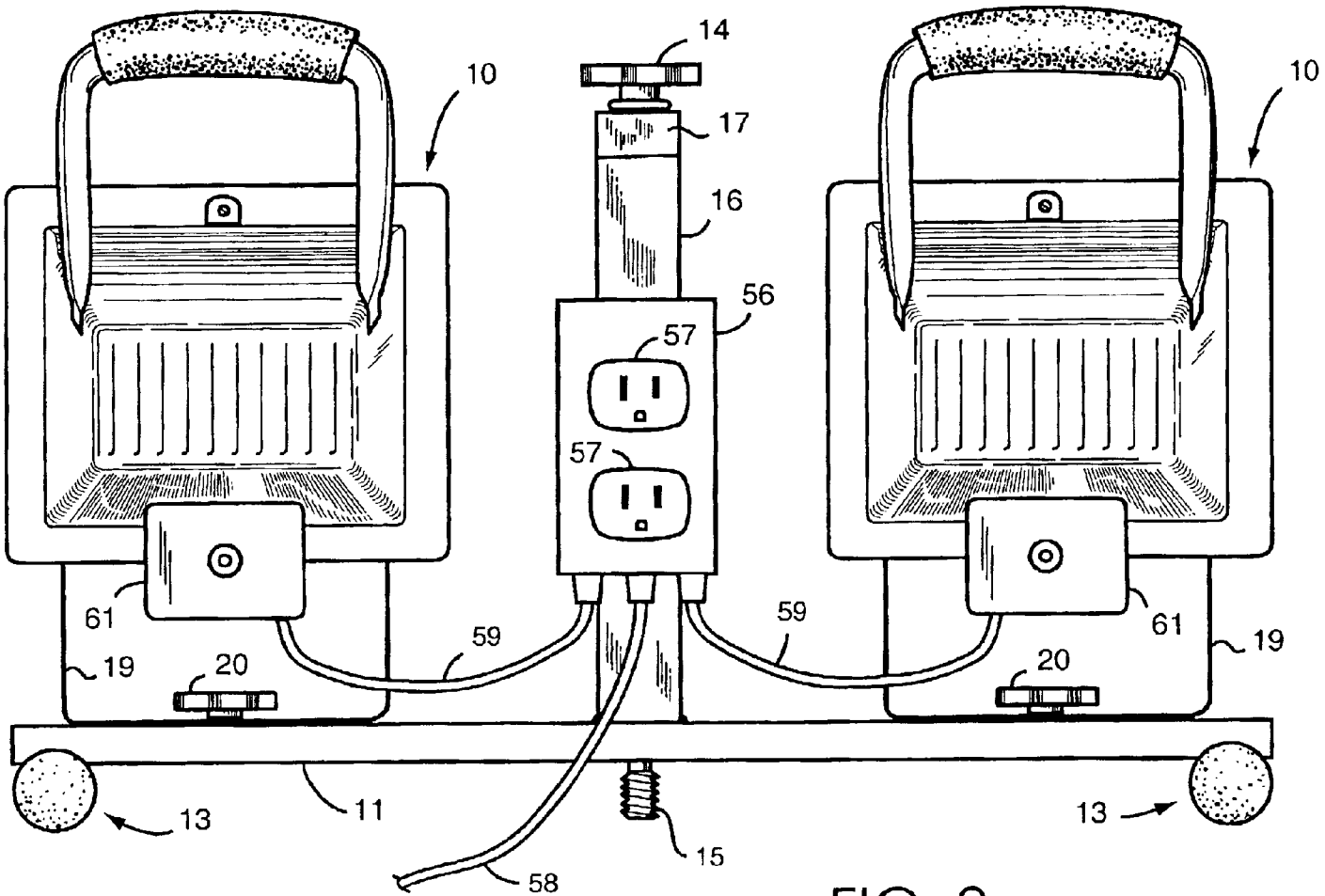
FIG. 2 is an overall rear elevational view of a worklight assembly in accordance with the invention shown as a stand-alone unit.
Figure 3:
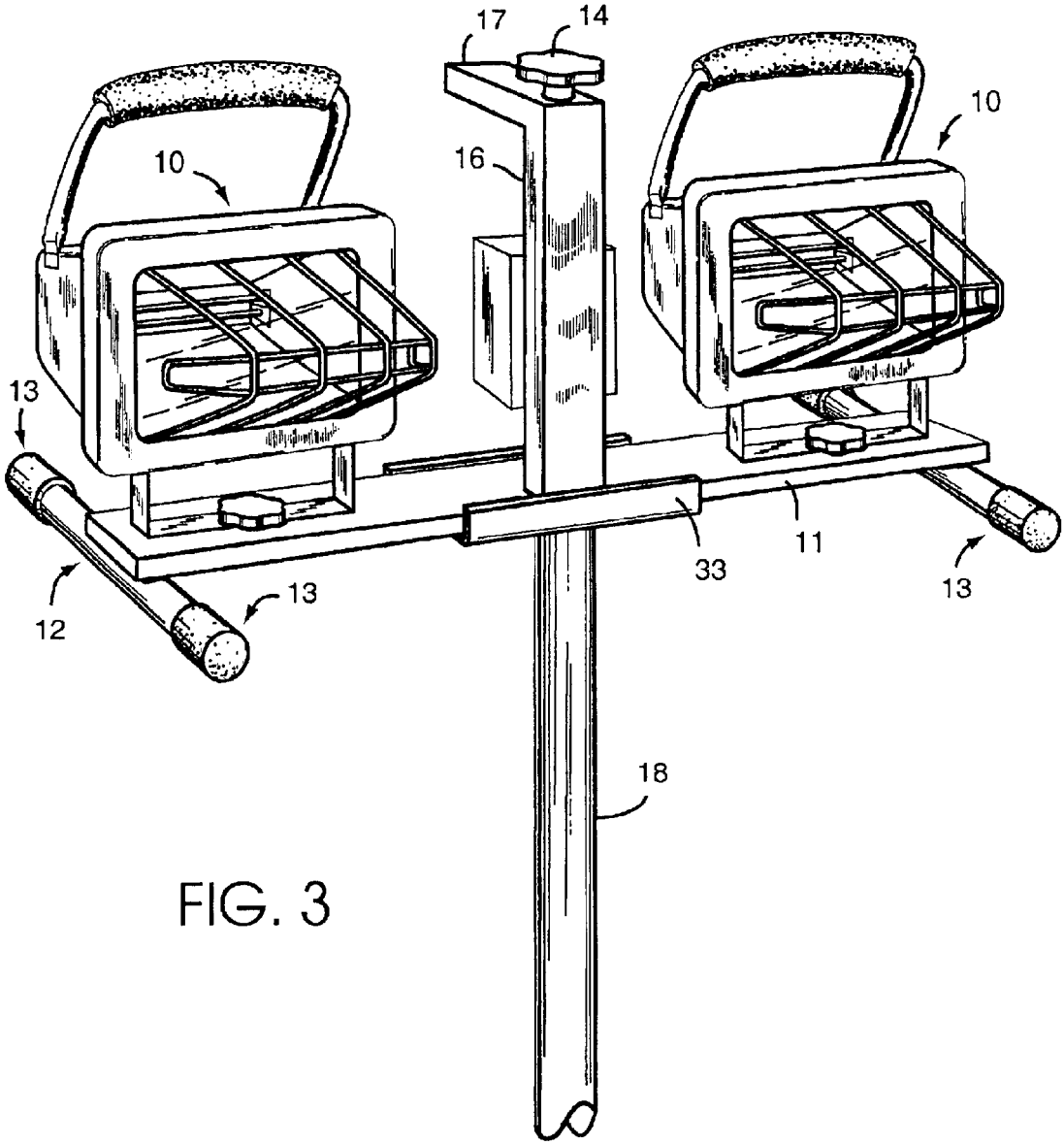
FIG. 3 is an overall view of a worklight assembly mounted on an elevating support structure.

FIGS. 1–3 provide an overall view of an illustrative embodiment of a worklight assembly according to the invention. The worklight assembly includes a plurality of worklight heads 10 that are mounted on a base portion that in this embodiment comprises support member 11 and tubular members 12. The tubular members define feet 13 for resting the worklight assembly on a work surface when the assembly is used as a stand-alone unit. To facilitate the quick changeover between a stand-alone unit and a mounted unit, the assembly includes a captured mounting mechanism, which here includes knob 14 and threaded rod end 15 visible in FIG. 2. A handle member 16 is disposed centrally on support member 11 and defines a grip member 17 that is disposed more or less over the mounting mechanism to facilitate manipulating the assembly while positioning it on, or removing it from, an elevating support structure such as tripod 18 shown in fragmentary part in FIG. 3. Knob 14 and threaded rod end 15 are joined by a shaft running through the hollow body of handle member 16, which is structured to capture the mounting mechanism.

The worklight heads 10 are a well-known conventional type and need not be described in any detail here. Although they are shown in the Figures as having a generally box-like shape, this is offered only for illustration and other shapes may also be used. The illustrated heads are halogen lights, but the invention may also be used with other types of lights such as fluorescents. FIGS. 1–3 show an embodiment with only two heads. The two-head arrangement is particularly desirable because it may be configured in a comparatively lightweight, compact and well-balanced embodiment providing ample illumination for most applications, which is particularly stable in its stand-alone and mounted configurations and is particularly easy to switch from one to the other. Nevertheless, the worklight assembly may be configured with other numbers of heads. When more than two heads are used, the heads are distributed on the base portion to maintain balance about the mounting mechanism to facilitate positioning the assembly on a tripod as will be understood from the descriptions below. Other aspects of the structure and operation of the invention in embodiments with more than two heads will readily be understood by those skilled in the art from the descriptions herein of two-head and single-head embodiments.

In the embodiment of FIGS. 1–3 the base portion includes support member 11 on which the two heads are mounted. The heads are mounted in a known manner by means of brackets 19 and knobs 20, which can be tightened to hold the brackets securely in place or loosened to permit the heads to be turned about the knob axis and aimed from side to side. While this mounting is convenient, other mountings may also be used.

The base portion serves as a built-in stand when the worklight assembly is used as a stand-alone unit. In the embodiment of FIGS. 1–3 the base portion includes discrete feet for engaging the work surface. The use of discrete feet, while operatively and cost-effective, is not necessary, and more generally, the base portion need only be formed at its lower reaches to engage the work surface so as to maintain the worklight in a stable disposition on the work surface.

In FIG. 1 the foot-defining tubular members 12 are secured at their middregions 21 to the underside of support member 11 in the vicinity of the lateral ends of the support member. The tubular members extend outward generally perpendicular to either side of support member 11, and the feet are formed by the outward extending end portions 13 of tubular members 12. These end portions carry friction-providing end pieces in the form of rubberized grips 22 to protect the work surface from scratches or other marring as well as to provide friction. It is not necessary that the feet be provided in directly opposing pairs as in the embodiment of FIG. 1. For example, feet extending on opposite sides of support member 11 may be offset from one another or an odd number of feet may even be used. For stability in those embodiments where discrete feet are used, there should of course be a minimum of three feet. The outwardly extending feet also need not constitute separately formed components but in alternative embodiments may be integrally formed with the base portion.

The requisite support may be achieved in a number of configurations. The feet may be disposed to support the entire weight of the horizontally extending support member and the worklight heads, or they may support only a portion of the weight, for example, where the horizontally extending support member, or a portion of it, is also formed and positioned to engage the work surface. In the embodiment of FIG. 1 the feet are connected to the underside of support member 11 so as to raise the support member off the work surface. In this configuration the feet support the entire weight of the worklight assembly when the assembly is positioned as a stand-alone unit on the work surface. In an alternative arrangement the feet may be disposed on the same level as support member 11, which also may then engage the work surface. While it is possible for horizontal support member 11 to engage the work surface along with feet 13, this arrangement is less desirable because it may make it more unsteady to set the unit down on an uneven surface, and for this reason an arrangement in which only the feet engage a flat work surface is preferred. The feet themselves may be formed with a variety of surface-engaging footprints covering, for example, a very small area or a more extended area.

In the embodiment of FIGS. 1–3 foot-defining member 12 is a straight tubular member of generally cylindrical cross section and extending generally perpendicularly from support member 11 with a protective, friction grip at the distal end. This is a particularly advantageous form of foot-defining member because it is compact, easy to manufacture, lends itself to convenient packaging for the worklight assembly, adds a minimum of weight, which is beneficial for reducing shipping costs, and is generally neat in appearance and convenient to use. Nevertheless, other configurations may also be used, for example, configurations having desirable ornamental and stylistic appearances or meeting the needs of specialized environments of use. Thus, for example, the foot-defining members need not be straight or cylindrical, but could also be curved or have other cross-sectional forms such as rectangular. Moreover, the foot-defining member need not be perpendicular to the support member, but more generally may extend in any transverse direction to the support member, which may be desirable for reasons of style or specialized applications. The foot-defining member need not be formed of a single piece, but may have a compound form comprising, for example, a separate component part that forms a work-surface-engaging foot portion secured for example to the distal end of a piece extending transversely from the worklight-head support member. Thus, the feet or foot-defining member in their most general form are not to be limited to that illustrated in the Figures.

For purposes of counting the number of feet in any particular embodiment, each of the four tubular end portions 13 shown in FIG. 1 extending outward in any one direction from support member 11 and engaging the work surface is counted as a single foot. Thus, the pair of tubular members 12 in the embodiment of FIG. 1 forms a total of four feet because each tubular member 12 extends in two opposite transverse directions from horizontally extending support member 11 to define two feet 13.

To make it easy for the user to go back and forth between a stand-alone unit and a tripod-mounted unit, it is desirable that the worklight assembly be well balanced front to back and side to side and that it be compact and comparatively lightweight without an excess of bulky or protruding support structures or other components. The arrangement illustrated herein with a horizontally extending principal support member for the worklight heads and a small number of transversely extending feet achieves this object. In addition it lends itself to economical manufacture, to generally smaller packaging, and even to being packed as a unit in a carrying case. In particular, the embodiment of FIG. 1 employing a straight and narrow cross bar for support member 11 and tubular members 12 for the feet 13 is especially successful in meeting these objects and advantages and for this reason may be preferred. Nevertheless, other shapes, styles and materials may also be used for the horizontally extending support member and feet without departing from the overall objects and advantages of the invention. If more general forms of base portions are used, it is helpful if the base portion is horizontally extending to help maintain a lower center of gravity for stability. In the embodiments illustrated here support member 11 is linearly extending, meaning thereby that it is generally longer than it is wide or high so that it has an appearance that may be described as generally narrow or strip-like. Although not necessary for all embodiments of the invention, a single "narrow," linearly extending support member 11 is desirable because it is compact and lightweight, contributes to simple, low-cost manufacture, and generally makes the worklight assembly easy to manipulate when mounting and demounting from an elevating support structure.

To assist in the quick and ready conversion, free from hindrances and difficulties, between a stand-alone unit and a mounted unit, a captured mounting mechanism is provided for alternatively mounting the support member on an elevating support structure, such as a telescoping tripod, and demounting the support member from the elevating support structure. The mounting mechanism is captured on the worklight assembly so that it is retained with the assembly when the assembly is used as a stand-alone unit and is maintained on the assembly in a ready disposition for attachment to the elevating support structure. The releasable mounting mechanism is self-contained on the worklight assembly in the sense that there are no normally separable parts such as a removable bolt or a pin or knob that must be held in a safe place such as in a toolbox or the user's pocket or alternatively attached to the worklight assembly or tripod structure by a clip or chain or special bracket to hold the separable part out of the way so as not to get lost or damaged while the worklight assembly is being used as a stand-alone unit or is being stored. This may be achieved for example by a captured bolt or rod as depicted in FIGS. 4A and 4B or through other self-contained means such as bayonet-type fittings, tensioning rings or other mechanical securement arrangements that remain attached to the worklight assembly generally ready to be used with a minimum of effort in securing the stand-alone unit to a tripod.

Figure 4A:
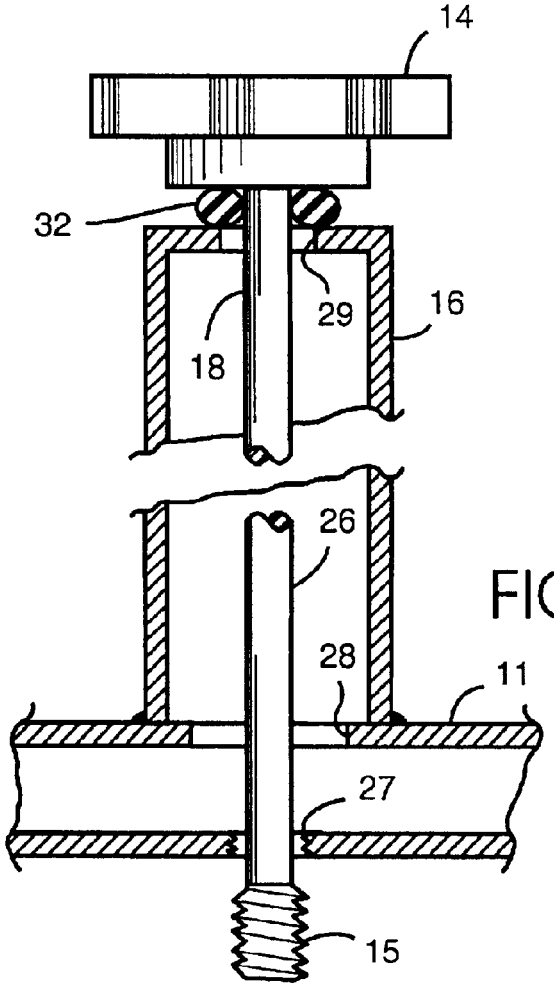
FIG. 4A is an elevational view partly in section of a mounting mechanism for the worklight assembly of FIG. 1.
Figure 4B:
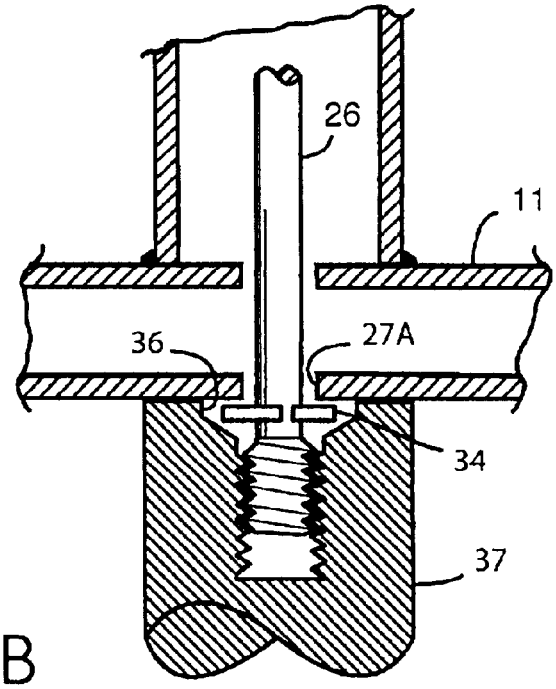
FIG. 4B is an elevational view partly in section of an alternative embodiment of a mounting mechanism.

FIG. 4A shows a first embodiment of an especially simple captured mounting mechanism. Horizontally extending support member 11 is shown in section. A vertically extending hollow handle member 16 is also shown in section. An elongate rod 26 runs vertically through handle member 16 and support member 11, which are provided with apertures 27, 28 and 29 of appropriate dimension for this purpose. The lower end of rod 26 is threaded at a first end with the threaded portion 15 extending all the way through the bottom of support member 11 in the disposition shown in FIG. 4A. The upper end of rod 26 extends through the top of handle member 16 and is terminated with a knob 14 of a sufficient diameter and for example having scalloped edges for easy gripping by the user. A grommet 32 surrounds rod 26 next to knob 14 to protect and at least partially seal the opening 29. The lower aperture 27 in the bottom face of support member 11 is threaded to receive mating threaded portion 15. This serves to capture rod 26 on the worklight assembly. While a certain amount of play is provided for limited vertical movement of the rod, the rod is nevertheless captured on the worklight assembly and cannot simply be detached in the normal course of demounting the assembly from a tripod or in anyway in the normal course of use. Removal of the rod here, should that be desired, calls for unscrewing threaded portion 15 through the bottom aperture 27 and pulling the rod up through the length of handle member 16. When the worklight is used as a stand-alone unit, knob 14 and grommet 32 rest on the top of handle 16 and threaded portion 15 hangs below horizontally extending support member 11, but not so far that the threaded portion interferes with the work surface on which the unit rests. That is, feet 13 provide enough clearance for rod 26 to extend through support member 11 a short ways yet avoid engagement or interference with the work surface in normal use. Alternatively, should interference with the work surface or the need for more clearance be an issue, threaded portion 15 may simply be partially screwed into aperture 27, where it will then be held by the interengaging threads. It should be noted that although in this arrangement rod 26 is "fixed" on the worklight assembly, it may nevertheless be completely removed by unscrewing the rod completely through threaded aperture 27 and pulling it up through the handle member. Internal aperture 28 in support member 11 and top aperture 29 may be made of sufficient diameter to accommodate the width of threaded portion 15 to facilitate such removal. Such removal, however, is not contemplated in the normal operation and use of the worklight assembly, and the threads in aperture 27 serve the greater purpose of providing a stop to retain the mounting mechanism on the worklight assembly.

It should be noted that as a variation on this embodiment internal aperture 28 may be threaded to mate with threaded portion 15 instead of aperture 27 on the underside of support member 11. It is desirable that either aperture 27 or 28 be threaded as a means of retaining the mounting rod 26 while the unthreaded apertures are formed with a diameter somewhat greater than that of threaded portion 15. This makes for easier manufacture and assembly since rod 26 with its threaded end 15 and knob 14 and grommet 32 may be separately fabricated and merely inserted into handle member 16.

Threaded rod portion 15 is dimensioned to be received in a mating threaded portion formed at the top of an elevating support structure such as tripod 18 partially shown in FIG. 3. When threaded portion 15 is screwed into the top of a tripod support, the underside of knob 14 is pulled down against handle 16, and the underside of support member 11 is held snugly against the top of the tripod structure, in particular, against receiving bracket 33 seen in FIG. 3.

While the use of a threaded bolt to secure a worklight assembly to a tripod structure is entirely conventional, what is not conventional is the arrangement of threaded rod 26 with respect to the worklight assembly even when not mounted on a tripod. To mount a worklight assembly of the present invention on a tripod or similar such elevating support structure, it is only necessary to place the worklight assembly in position on the elevating support structure, which can generally be accomplished with one hand, and then reach over and turn knob 14. There is no need for fumbling to find the knob in a toolbox or for removing the rod from a separate holding place or for inserting the rod through any aperture to get it in position for mounting. The invention instead provides for a simple "position and turn" mounting. The worklight assembly is positioned on the elevating support structure and the knob is turned to tighten down the assembly thereby offering a great convenience to the user. The rod 26 is retained on the worklight assembly and arranged substantially in position for mounting the assembly on an elevating support structure. This is so notwithstanding the small play in the position of the rod or a possible retracted disposition of rod 26 in which threaded portion 15 is screwed partially into aperture 27. In spite of such small variations in the position of rod 26, apart from positioning the worklight assembly on the tripod, the user is called upon to execute substantially only a single action, namely, turn knob 14 to screw the rod into its securing position on the tripod. By way of contrast, a simple threaded bolt extending through an unthreaded or even a threaded aperture is not assured of providing this benefit because it provides no guard against the bolt simply being removed, intentionally or inadvertently, in the normal course of demounting the worklight assembly merely by unscrewing the bolt too far. In particular, a simple bolt extending through an unthreaded aperture with no capturing means is prone to falling out or otherwise becoming separated. That is to say, an important benefit of a captured mechanism is that the operative mechanism is always in the right location ready for the user to secure it to the elevated support structure with a minimum of effort and without any fumbling or searching for a knob or bolt; and that the mechanism is not freely removable from the worklight assembly in the normal course of use so that it cannot become lost or misplaced and so that the user can depend on its being in position, with at most minor adjustment, for securing to the elevating support structure and so that the user need not be concerned with where to store a separable bolt or knob when the assembly is used as a stand-alone unit or is being stored. Thus, a captured mechanism is not freely removable in the ordinary course of usage, although provision may be made even for an operative portion of a captured mechanism such as rod 26 in FIG. 4A to be deliberately removed through supplemental action beyond that employed in the ordinary course of usage. While the presence of a captured mounting mechanism may seem a small structural difference over known tripod-mountable worklights, it leads to a substantial improvement in the convenience and ease of use to the user that has not heretofore been recognized.

FIG. 4B shows an alternative embodiment of a mounting mechanism. Here the lower aperture 27A in the bottom face of support member 11 need not be threaded. Rod 26 extends through the lower aperture 27A and is retained by a retaining member 34, shown here in the form of a stop washer such as a so-called E-clip seen in FIG. 4B, although other forms of washer or other such arrangements can also be used. When a retaining member 34 is used, which is disposed on the underside of horizontally extending support member 11, it will generally be necessary for there to be a recess 36 for receiving retaining member 34 in the top of the support shaft 37 of the elevating support structure or in any associated support bracket that may be used. Recess 36 provides room to receive retaining member 34 when the worklight assembly is tightly secured on support shaft 37. Without recess 36 support member 11 may have room to rock slightly on support shaft 37 or on an associated support bracket because of the thickness the retaining member.

The embodiment of worklight assembly shown in FIG. 1 includes centrally disposed handle member 16. The handle is secured to support member 11 both for carrying the worklight assembly about when used as a stand-alone unit and for facilitating the mounting on a tripod. The handle may be permanently secured to the support member as illustrated in the Figures, or it may be detachably secured. A detachably secured handle may be desirable for example for enabling the assembly to be disassembled for storage in a small carrying case or for enabling the assembly to be packed into a smaller package for shipping.

The handle member has an upper portion defining grip member 17 for carrying the assembly and for holding the assembly while mounting on a tripod. The handle member is generally shaped and disposed so that the grip member is more or less over the mounting mechanism and more or less over the center of gravity, although it may be somewhat forward or back of the mounting mechanism and center of gravity in particular embodiments. This disposition is referred to herein as generally over the mounting mechanism. The grip member so disposed serves as a convenient way to carry the worklight assembly with one hand when used as a stand-alone unit. This disposition of the grip member adds substantially to the ease with which the assembly may be carried. There is another advantage, however, to the disposition of the grip member more or less over the mounting mechanism and center of gravity and this arises in mounting and demounting the worklight assembly onto and from the elevating support structure. The assembly may be conveniently lifted into position on the elevated support structure and maintained in that position with one hand while the assembly is secured to the elevating support structure. With the grip member disposed in this manner it is particularly easy to hold the assembly in steady position on the elevating support structure while the mounting mechanism is tightened with the other hand. While this might seem a small design difference, it substantially adds to the ease and convenience in mounting and demounting the worklight assembly from the elevating support structure.

Figure 5:
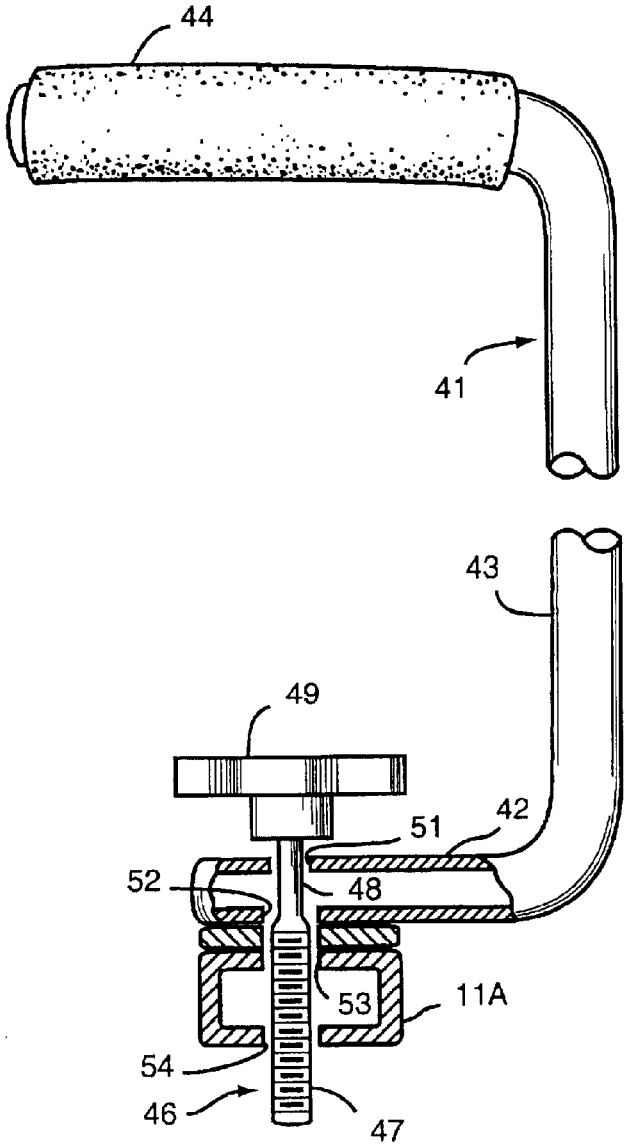
FIG. 5 is a side elevational view partly in section of an alternative embodiment of handle and mounting mechanism.
Figure 6:
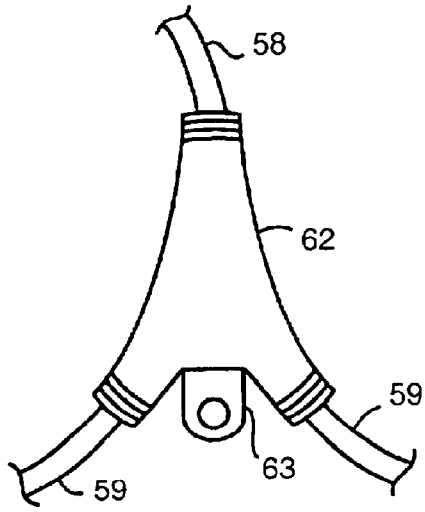
FIG. 6 is an elevational view of an electrical junction for use with the invention.

FIG. 5 shows an alternative handle and mounting mechanism embodiment, in which the handle member includes an elongated, generally U-shaped tubular member 41 having a lower horizontally extending arm 42 secured to support member 11A, a vertically extending arm 43 and an upper horizontally extending arm 44 forming the grip member. The U-shaped embodiment is advantageous in that it is simple to manufacture and in that it positions the grip member directly over the mounting mechanism. The mounting mechanism is provided by a rod 46 that has a threaded portion 47 extending over a large proportion of its length and an unthreaded portion 48 of smaller diameter. The top end of the rod terminates in a knob 49. Lower arm 42 is provided with apertures 51 and 52 in its upper and lower walls, and corresponding apertures 53 and 54 are provided in the upper and lower walls of support member 11A. Rod 46 extends through the apertures so that the distal end of the rod extends through the bottom aperture 54 and is exposed for connection to a tripod. Upper aperture 51 is threaded and the other apertures 52, 53, 54 are of slightly larger diameter so that rod 46 is retained by the upper threaded aperture 51. In normal operation knob 49 rests on top of lower arm 42 and the reduced diameter portion 48 of the rod passes through aperture 51. The rod and knob are able to undergo limited vertical movement the length of reduced diameter portion 48 to facilitate mounting the assembly on a tripod. The threaded upper aperture 51 acts as a stop limiting the vertical movement and capturing the rod. The extra long threaded portion 47 serves to keep the rod aligned in apertures 53 and 54 even when the rod is raised to the top positioned permitted by the unthreaded portion 48.

While a centrally disposed handle member adds to the compactness of the worklight assembly, it is not the only form or disposition of handle that can be used. For example, a pair of handle members may be attached at lateral ends of a horizontally extending base portion. A conveniently positioned grip member may be joined to and supported by the lateral handle members.

Electrical power is provided to worklight heads 10 through a power junction on the worklight assembly. In FIGS. 1–3 this is provided by junction box 56, which may also conveniently include a supplementary power outlet 57. For clarity the electrical lines have been eliminated from FIG. 1, but are shown in FIG. 2. A main power cord 58 is provided for connection to an external source of power. Secondary lines 59 distribute the power to worklight heads 10 at splice boxes 61. The electrical contact connections are entirely conventional and need not be described in detail here. It is of course necessary, if the worklight assembly is to be used as a stand-alone unit, that the electrical distribution connections for power distribution to the worklight heads be self-contained on the worklight assembly. To that end, the power junction 58 is secured to handle member 16 in the embodiment of FIGS. 1–3. In the past it has generally been considered preferable for the power distribution junction to be secured to the tripod to provide for a lower center of gravity and presumably a greater stability against tipover when the heads are mounted on the tripod. Ample stability against tipover may nevertheless be achieved in the present invention particularly with the compact and streamline construction as shown in the embodiments disclosed here. While a junction box with supplementary outlet is shown in the embodiment of the FIGS. 1–3, the invention is not limited to this type of power distribution arrangement. For example, a simple Y-junction 62 may be used, which is preferably secured to the worklight assembly, for example, to handle member 16. Apertured tab 63 is provided for this purpose. Secure attachment of the power distribution junction to the worklight assembly is preferred because it reduces the length of free-hanging electrical line that is available to potentially get in the user's way when mounting or demounting the worklight assembly on or from a tripod. However, secondary lines 59 of short length with a lightweight Y-connector or similar such arrangement could be used, although not generally preferred. For a plurality of worklight heads greater than two, a Y-type connector may be used having the main electrical cord coming in and several cords going out to the several worklight heads. The important point is that the junction be maintained with the worklight assembly and not, for example, secured to the tripod structure, which would of course impede the ready convertibility between a mounted unit and a stand-alone unit.

Figure 7:
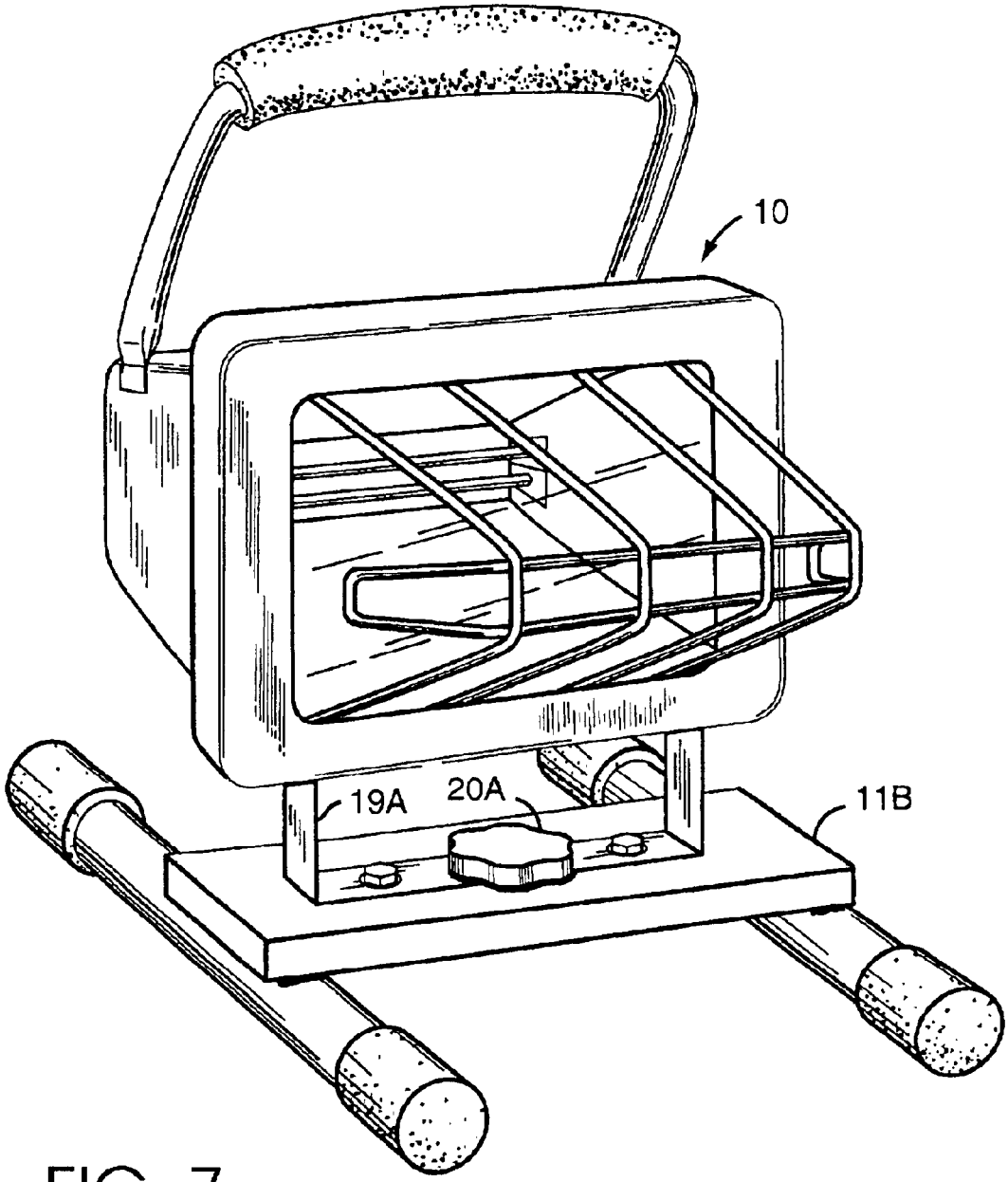
FIG. 7 is a perspective view of an alternative embodiment of the invention with a single worklight head.

As mentioned above, the dual-use portable worklight assembly of the present invention may also be configured with a single worklight head. Such an embodiment is shown in FIG. 7. Here bracket 19A is secured to support member 11B for example with bolts as shown. The central knob 20A is not used for loosening and tightening the bracket, but is instead used for the mounting mechanism, which may be configured as shown in FIG. 5. Here since there is no handle member 41, and consequently no lower arm 42, the aperture in the upper wall of support member 11B is threaded. The unthreaded portion of the rod provides the limited vertical movement as in the embodiment of FIG. 5.

The above descriptions and drawings are given to illustrate and provide examples of various aspects of the invention in various embodiments. It is not intended to limit the invention only to these examples and illustrations. Given the benefit of the above disclosure, those skilled in the art may be able to devise various modifications and alternate constructions that although differing from the examples disclosed herein nevertheless enjoy the benefits of the invention and fall within the scope of the invention as defined by the following claims.

What is claimed is:

1. A portable worklight assembly for use both as a stand-alone unit positionable on a work surface and as a supported unit mountable on an elevating support structure, said worklight assembly comprising:

a base portion and a plurality of worklight heads mounted thereon;

said base portion being formed at its underside to engage said work surface for supporting said worklight assembly when said assembly is used as a stand-alone unit positioned on said work surface; and a mounting mechanism for alternatively mounting said base portion on and demounting said base portion from said elevating support structure, wherein said mounting mechanism is captured on said worklight assembly in a disposition generally ready for attachment to said elevating support structure, said mounting mechanism being retained in a disposition free from interference with said work surface when said assembly is positioned thereon as a stand-alone unit.

2. The apparatus of claim 1, further comprising:

a grip member disposed so as to enable gripping at a location generally over said mounting mechanism whereby a user may conveniently position said worklight assembly on said elevating support structure with said mounting mechanism in ready disposition to be secured to said elevating support structure.

3. The apparatus of claim 2 wherein said plurality of worklight heads consists of a pair of side by side worklight heads and said mounting mechanism is disposed on said base portion centrally between said pair of worklight heads.

4. The apparatus of claim 1, further comprising:

an electrical junction secured to said worklight assembly for distributing electrical power to said plurality of worklight heads from a power cord when said assembly is used as a stand-alone unit and as a mounted unit on said elevating support structure.

5. The apparatus of claim 1, further comprising:

a grip member disposed so as to enable gripping at a location generally over said mounting mechanism whereby a user may conveniently position said worklight assembly on said elevating support structure with said mounting mechanism in ready disposition to be secured to said elevating support structure; and an electrical junction secured to said worklight assembly for distributing electrical power to said plurality of worklight heads from a power cord when said assembly is used as a stand-alone unit and as a mounted unit on said elevating support structure.

6. A portable dual-head worklight assembly for use both as a stand-alone unit positionable on a work surface and as a supported unit mountable on an elevating support structure, said worklight assembly comprising:

a base portion and a pair of worklight heads mounted thereon;

said base portion including at least three support feet disposed and connected to said base portion for support thereof, said feet being structured and arranged to engage said work surface for supporting said worklight assembly when said assembly is used as a stand-alone unit positioned on said work surface;

a mounting mechanism for alternatively mounting said base portion on and demounting said base portion from said elevating support structure, wherein said mounting mechanism is captured on said worklight assembly in a disposition generally ready for attachment to said elevating support structure, said mounting mechanism being retained in a disposition free from interference with said work surface when said assembly is positioned thereon as a stand-alone unit.

7. The apparatus of claim 6 wherein said mounting mechanism comprises a rod formed at a distal end for securement to said elevated support structure, said rod being captured so as to permit at most only limited vertical movement in the course of mounting and demounting said worklight assembly.

8. The apparatus of claim 7 wherein said rod is threaded at said distal end for securement to said elevating support structure.

9. The apparatus of claim 8 wherein said base portion includes an aperture, said rod extends through said aperture, and said apparatus further includes means for retaining said rod distal end on one side of said aperture.

10. The apparatus of claim 9 wherein said aperture is threaded to mate with said threaded distal end and said threaded distal end extends all the way through said threaded aperture whereby said threaded distal end and said threaded aperture retain said distal end on one side of said aperture.

11. The apparatus of claim 9 wherein said means for retaining comprises a stop washer about said rod.

12. The apparatus of claim 6, further comprising:

a grip member disposed so as to enable gripping at a location generally over said mounting mechanism whereby a user may conveniently position said worklight assembly on said elevating support structure with said mounting mechanism in ready disposition to be secured to said elevating support structure.

13. The apparatus of claim 12, further comprising:

a handle member centrally disposed between said pair of worklight heads and secured to said base portion, said handle member defining said grip member.

14. The apparatus of claim 12, further comprising:

an electrical junction for distributing electrical power to said pair of worklight heads from a power cord when said assembly is used as a stand-alone unit and as a mounted unit on said elevating support structure, said electrical junction comprising a junction box mounted on said handle member.

15. The apparatus of claim 13, further comprising:

an electrical junction for distributing electrical power to said pair of worklight heads from a power cord when said assembly is used as a stand-alone unit and as a mounted unit on said elevating support structure, said electrical junction comprising a Y-connector mounted on said handle member.

16. The apparatus of claim 6, further comprising:

an electrical junction disposed on said worklight assembly for distributing electrical power to said pair of worklight heads from a power cord when said assembly is used as a stand-alone unit and as a mounted unit on said elevating support structure.

17. The apparatus of claim 16 wherein said electrical junction comprises a junction box.

18. The apparatus of claim 16 wherein said electrical junction comprises a Y-connector.

19. The apparatus of claim 6, further comprising:

a handle member centrally disposed between said pair of worklight heads and secured to said base portion, said handle member defining a grip member disposed so as to enable gripping at a location generally over said mounting mechanism whereby a user may conveniently position said worklight assembly on said elevating support structure with said mounting mechanism in ready disposition to be secured to said elevating support structure; and wherein said mounting mechanism comprises a rod formed at a distal end for securement to said elevated support structure, said rod being captured so as to permit at most only limited vertical movement in the course of mounting and demounting said worklight assembly, said rod distal end extending through an aperture in said base portion for engaging said elevating support structure.

20. The apparatus of claim 19 wherein said electrical junction is mounted on said handle member.

21. A portable worklight assembly for use both as a stand-alone unit positionable on a work surface and as a supported unit mountable on an elevating support structure, said worklight assembly comprising:

a base portion and a single worklight head mounted thereon;

said base portion being formed at its underside to engage said work surface for supporting said worklight assembly when said assembly is used as a stand-alone unit positioned on said work surface; and a mounting mechanism for alternatively mounting said base portion on and demounting said base portion from said elevating support structure, wherein said mounting mechanism is captured on said worklight assembly in a disposition generally ready for attachment to said elevating support structure, said mounting mechanism being retained in a disposition free from interference with said work surface when said assembly is positioned thereon as a stand-alone unit.

22. A portable dual-head worklight assembly for use both as a stand-alone unit positionable on a work surface and as a supported unit mountable on an elevating support structure, said worklight assembly comprising:

a horizontally extending support member and a pair of worklight heads mounted thereon;

at least three support feet disposed and connected to said support member for support thereof, said feet being structured and arranged to engage said work surface for supporting said worklight assembly when said assembly is used as a stand-alone unit positioned on said work surface;

a mounting mechanism for alternatively mounting said base portion on and demounting said base portion from said elevating support structure, wherein said mounting mechanism comprises a rod extending through said support member and formed at a first end for securement to said elevated support structure, said rod being captured in its disposition extending through said support member so as to be ready for securement to said elevating support structure and being retained in a disposition free from interference with said work surface when said assembly is positioned thereon as a stand-alone unit; and an electrical junction disposed on said worklight assembly for distributing electrical power to said pair of worklight heads from a power cord when said assembly is used as a stand-alone unit and as a mounted unit on said elevating support structure.

23. The apparatus of claim 22 wherein said feet extend outwardly from said support member.

24. The apparatus of claim 23 wherein said horizontally extending support member is linearly extending.

25. The apparatus of claim 24 wherein each said foot is provided by a foot-defining member extending transversely from said support member and being structured and arranged to engage said work surface at least at a position outwardly from said support member.

26. The apparatus of claim 25 wherein each said foot-defining member comprises a linearly extending member extending substantially perpendicular to said support member.

27. The apparatus of claim 26 wherein said foot-defining member further comprises a friction-providing end piece for engaging said work surface.

28. The apparatus of claim 25 wherein said foot-defining members are disposed to raise said support member off said work surface whereby said feet provide the principal support for said worklight assembly when said assembly is used as a stand-alone unit positioned on said work surface.

29. The apparatus of claim 22, further comprising a handle member centrally disposed between said pair of worklight heads and secured to said support member whereby a user may conveniently position said worklight assembly on said elevating support structure with said mounting mechanism in ready disposition to be secured to said elevating support structure.

30. The apparatus of claim 29, wherein said handle member comprises:

a generally vertical tubular portion secured to said support member, and a grip member at the distal end of said tubular portion; and said mounting mechanism is further characterized in that said rod extends vertically through said tubular member and terminates in a knob disposed in the vicinity of said grip member for use in securing said rod at said first end to said elevating support structure.

31. The apparatus of claim 30 wherein said mounting mechanism is structured and arranged to permit limited vertical movement of said rod to facilitate seating on said elevating support structure.

32. The apparatus of claim 29, wherein said handle member comprises:

a generally U-shaped tubular member having a first, horizontally extending, arm secured to said support member, a second, vertically extending arm, and a third, horizontally extending arm providing a grip member; and said mounting mechanism is further characterized in that said rod extends vertically through said first arm and terminates in a knob disposed in the vicinity of said first arm for use in securing said rod at said first end to said elevating support structure.

33. The apparatus of claim 32 wherein said mounting mechanism is structured and arranged to permit limited vertical movement of said rod to facilitate seating on said elevating support structure.

34. A portable dual-head worklight assembly for use both as a stand-alone unit positionable on a work surface and as a supported unit mountable on an elevating support structure, said worklight assembly comprising:

a linearly extending support member having first and second distal ends, and a pair of worklight heads mounted thereon;

first and second generally tubular members secured at their midregions to said support member in the vicinity of said first and second ends, respectively, said first and second generally tubular members extending horizontally outward to either side of said support member, the outward extending portions of each said generally tubular member defining feet for engaging said work surface and supporting said worklight assembly when said assembly is used as a stand-alone unit positioned on said work surface;

a handle member centrally disposed between said pair of worklight heads and secured to said support member whereby a user may conveniently position said worklight assembly on said elevating support structure for mounting thereto;

a mounting mechanism for alternatively mounting said support member on and demounting said support member from said elevating support structure, wherein said mounting mechanism comprises a rod extending through said support member and formed at a first end for securement to said elevated support structure, said rod being captured in its disposition extending through said support member so as to be ready for securement to said elevating support structure and being retained in a disposition free from interference with said work surface when said assembly is positioned thereon as a stand-alone unit;

said rod extending through at least a portion of said handle member and terminating in a knob for use in securing said rod at said first end to said elevating support structure; and an electrical junction disposed on said worklight assembly for distributing electrical power to said pair of worklight heads from a power cord when said assembly is used as a stand-alone unit and as a mounted unit on said elevating support structure.

35. The apparatus of claim 34 wherein said first and second generally tubular members are straight and extend perpendicular to said support member.

36. The apparatus of claim 34 wherein said mounting mechanism is structured and arranged to permit limited vertical movement of said rod to facilitate seating on said elevating support structure.

* * * * *